US006685102B1

(12) United States Patent
Mi et al.

(10) Patent No.: US 6,685,102 B1
(45) **Date of Patent: *Feb. 3, 2004**

(54) OSCILLATING JETS

(75) Inventors: Jianchun Mi, Rostrevor (AU); Russell Estcourt Luxton, Eastwood (AU); Graham Jerrold Nathan, Blackwood (AU)

(73) Assignee: Luminis Pty., Ltd., Adelaide (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/554,664

(22) PCT Filed: Nov. 18, 1998

(86) PCT No.: PCT/AU98/00959

§ 371 (c)(1),
(2), (4) Date: Aug. 14, 2000

(87) PCT Pub. No.: WO99/26021

PCT Pub. Date: May 27, 1999

(30) Foreign Application Priority Data

Nov. 18, 1997 (AU) ..... PP 0421

(51) Int. Cl.[7] ..... B05B 17/00

(52) U.S. Cl. ..... 239/1; 239/589.1; 239/601

(58) Field of Search ..... 239/589, 589.1, 239/596, 601, 1

(56) References Cited

U.S. PATENT DOCUMENTS 4,148,338 A * 4/1979 Skoli
4,991,561 A 2/1991 Gerassimov et al.
5,060,867 A * 10/1991 Luxton et al.
5,769,624 A * 6/1998 Luxton et al.

FOREIGN PATENT DOCUMENTS

AU 16235/88 11/1988

* cited by examiner

*Primary Examiner*—Christopher Kim
(74) *Attorney, Agent, or Firm*—Sughrue Mion, PLLC

(57) ABSTRACT

A method for producing a fluidic device (2) for exciting an oscillating jet (12) of predetermined oscillation and mixing characteristics. The fluidic device (2) includes a chamber (4) having a fluid outlet (6) longitudinally displaced from a fluid inlet (8). The fluid inlet (8) is disposed such that in use the fluid (10) entering the chamber (6) through the fluid inlet (8) separates from the inner surface of chamber (4) to excite an oscillating jet (12). The method includes the step of configuring the geometry of the shape and/or dimensions of the cross section of the fluid inlet (8) to determine the mode of oscillation and mixing characteristics of the oscillating jet (12). A fluidic device (2') for exciting an oscillating jet (12') whose characteristics can be determined to meet operational requirements.

31 Claims, 8 Drawing Sheets

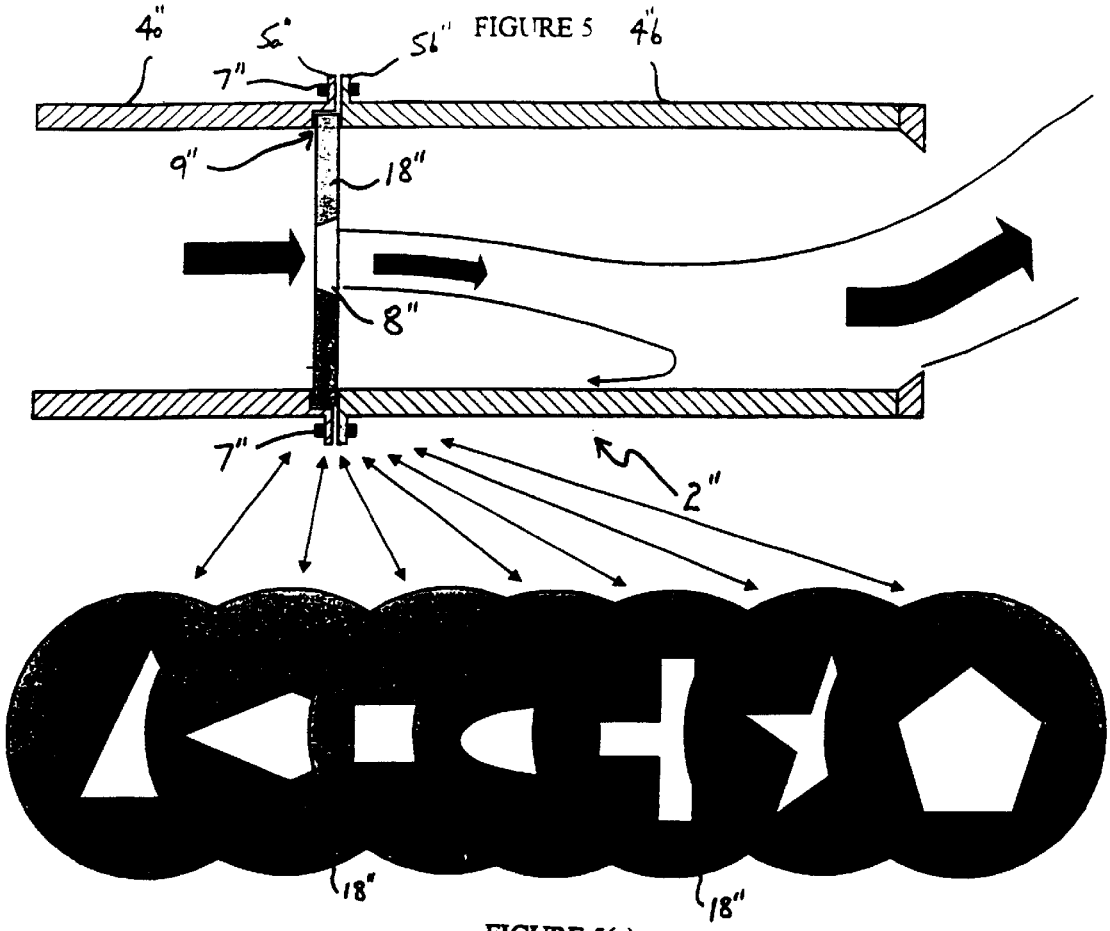
FIGURE 5
FIGURE 5(a)
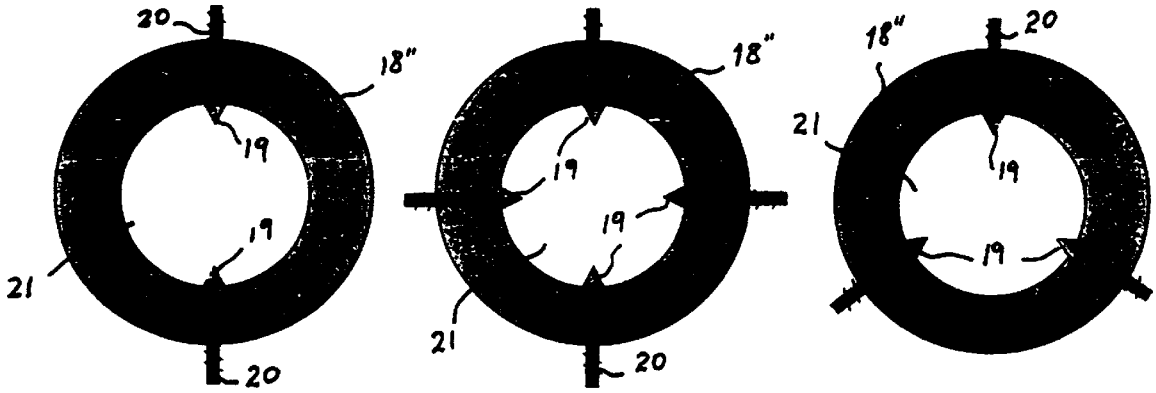
FIGURE 5(b)

OSCILLATING JETS

FIELD OF THE INVENTION

This invention relates to oscillating jets.

BACKGROUND ART

Oscillating jets are jets that are excited to exhibit dynamic modes of oscillation. While oscillating jets may potentially be excited to exhibit diverse modes of oscillation, illustrative examples of oscillating jets include the "flapping jet" wherein the jet column "flaps" from side to side in a quasi-planar fashion, and the "precessing jet" wherein the jet column rotates (or "precesses") as a whole about an axis other than its own.

Oscillating jets, such as the precessing jet and the flapping jet, have broad potential industrial applicability in the mixing of fluids due to their enhanced mixing characteristics relative to conventional non-oscillating jets. Examples of industrial processes in which oscillating jets have potential applicability include combustion systems, chemical reactors, heat and mass exchangers, fluid mixers, and spray systems.

The potential widespread practical application of oscillating jets to mix fluids has at least partially been facilitated by the development of simple fluidic devices capable of exciting oscillating jets. For example, the present applicant's international patent publication WO88/08104 discloses several simple fluidic devices capable of exciting an oscillating jet without acoustic or mechanical excitation techniques. Specifically, the fluidic devices disclosed in WO88/08104 use the separation of a primary flow in a chamber to excite a large-scale, low frequency precessing jet.

While industrial application of the fluidic devices disclosed in WO88/08104 as burners in rotary cement kilns has demonstrated that a gas precessing jet flame is highly stable and significantly reduces $No_x$ emissions relative to conventional non-oscillating flames, the broader industrial application of the precessing jet has been hindered by the absence of a capability to manipulate and regulate directly the evolution and mixing characteristics of the jet. In this regard, it will be appreciated that the ability to adapt and regulate the mixing characteristics of a jet is essential if the performance of the jet is to be optimised for any given industrial application.

The above example of the precessing jet clearly illustrates that the broad industrial application of oscillating jets generally is not merely contingent upon the development of simple fluidic devices, but also upon the development of a capability whereby the evolution and mixing characteristics of the oscillating jets excited by such devices can be simply and readily adapted to mix fluids in a predetermined manner that is optimal for any given industrial process.

Several fluidic devices have been proposed in the present applicant's international patent publications WO94/07086 and WO96/27761 to address the above technical problem in the context of the precessing jet burners. These fluidic devices are improvements of the fluidic devices disclosed in WO88/08104 wherein a precessing jet flame is combined with a closely proximate non-oscillating jet flame is used to influence the characteristics of the combined flame. While the fluidic devices disclosed in WO94/07086 and WO96/27761 advantageously enhance the performance of the precessing jet in combustion systems such as rotary cement kilns, they do not directly facilitate the optimisation of the performance of the precessing jet for other specific industrial applications because they do not provide the capability of direct, simple adaptation and regulation of the mixing characteristics of the precessing jet itself.

Against the above background, the present applicant has determined that a requirement exists for a simple fluidic device for exciting an oscillating jet whose mode of oscillation and mixing characteristics can be determined such that the performance of the oscillating jet can be optimised for any given industrial application. Importantly, the device should not only be capable of exciting the above illustrative examples of the flapping jet and the processing jet, but a broad range of oscillating jets whose particular dynamic modes of oscillation and mixing characteristics are optimal for specific industrial applications.

DISCLOSURE OF THE INVENTION

In general, according to a first aspect of the present invention, there is provided a method of producing a fluidic device for exciting an oscillating jet having predetermined characteristics, the fluidic device including a chamber having a fluid inlet such that in use fluid entering the chamber through the fluid inlet separates from the inner surface of the chamber to excite an oscillating jet, the method including the step of:

configuring the geometry of the fluid inlet to determine the mode of oscillation and mixing characteristics of the oscillating jet.

Advantageously, the mode of oscillation and mixing characteristics of the oscillating jet excited by the fluidic device are determined by selectively configuring the geometry of the cross-section of the fluid inlet. Advantageously, the geometry of the cross-section of the fluid inlet is non-circular and is selectively configured to be triangular, rectangular, polygonal or elliptical (other geometric plane figures such as crosses and stars may be used with advantage in some embodiments). Advantageously, the geometry of the cross-section of the fluid inlet may be further selectively configured by varying dimensions of the cross-section of the fluid inlet.

In another aspect, the present invention provides a fluidic device for exciting an oscillating jet whose characteristics can be determined to meet operational requirements, the fluidic device including a chamber having a fluid inlet such that in use fluid entering the chamber through the fluid inlet separates from the inner surface of the chamber to excite an oscillating jet, wherein means are provided to vary the geometry of the fluid inlet such that the mode of oscillation and mixing characteristics of the oscillating jet can be determined to meet operational requirements.

Advantageously, the means provided to vary the geometry of the fluid inlet comprise a plurality of elements that may be alternatively removably positioned inside the chamber, each of the elements being provided with an orifice that constitutes the fluid inlet when the respective elements are removably positioned in the chamber. Advantageously, the orifices of the respective elements possess different geometries. Advantageously, the orifices provided in the respective elements are non-circular in cross-section. Accordingly, the shape of the cross-section of the orifice may be selected to be triangular, rectangular, polygonal, or elliptical (other geometric plane figures such as crosses and stars may be used with advantage in some embodiments).

Conveniently, once the fluidic device has been installed for service in a particular industrial application, the geometry of the fluid inlet can be simply and readily varied by substituting one element for another having a differently configured orifice. It will be appreciated from the above method of the present invention that the selective variation of the geometry of the fluid inlet facilitates the manipulation and regulation of the mode of oscillation and mixing characteristics of the oscillating jets excited by the fluidic device. Accordingly, the performance of the oscillating jet excited by the fluidic device can be optimised and/or varied to meet the specific service requirements of any given practical application.

As an alternative to the use of removably positionable orifices, means could be integrally provided in the fluidic device to vary the geometry of the fluid inlet in situ by mechanical or fluidic means such that the mode of oscillation and mixing characteristics of the oscillating jet can be determined to meet operational requirements.

Embodiments of the present invention will now be described, by way of example only, with reference to the accompanying drawings:

BRIEF DESCRIPTION OF THE DRAWINGS

FIG. 5 is a schematic view of a fluidic device for exciting an oscillating jet whose characteristics can be determined to meet operational requirements by the use of mechanical means to vary the shape of the inlet. FIG. 5(*a*) achieves this variation by means of inter-changeable components, and FIG. 5(*b*) achieves it by means of adjustments that are possible in-situ;

BEST MODES FOR CARRYING OUT THE INVENTION

Figure 1:
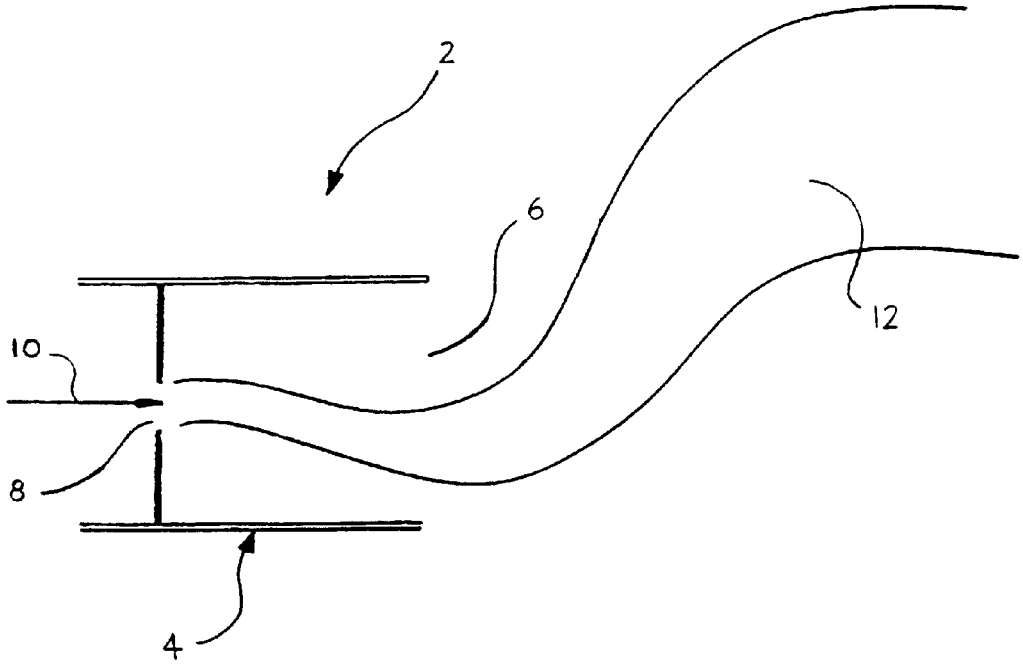
FIG. 1 is a schematic view of a fluidic device for exciting an oscillating jet produced in accordance with the present invention.
Figure 2A:
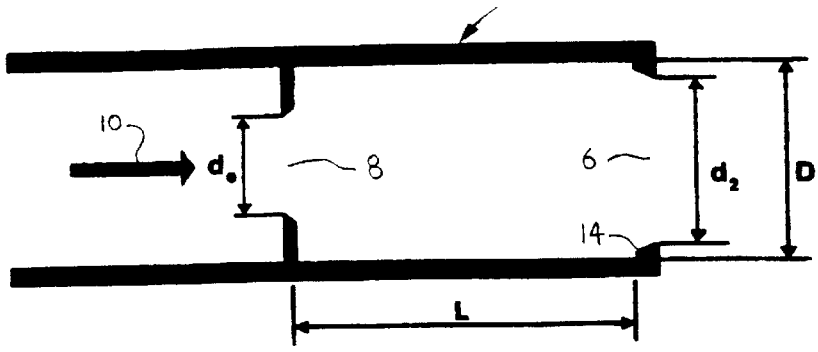
FIGS. 2(*a–h*) illustrate a selection of alternative embodiments of fluidic devices for exciting an oscillating jet produced in accordance with the present invention.
Figure 2B:
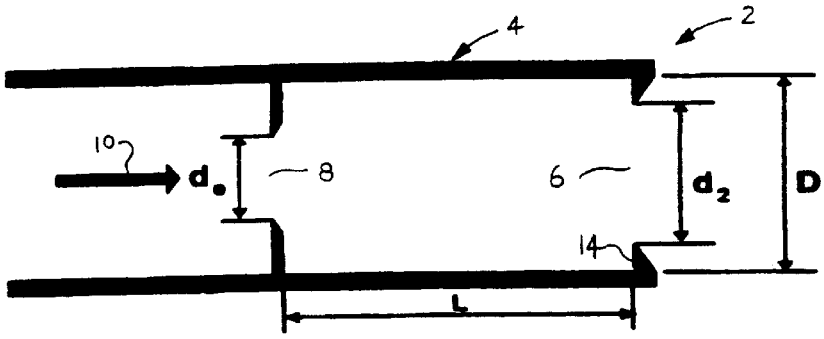
Figure 2C:
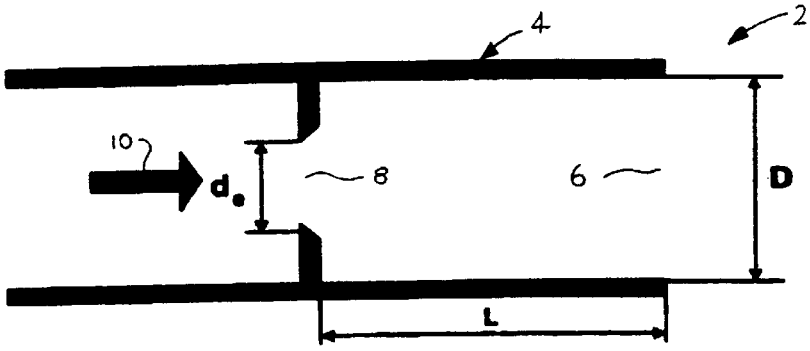
Figure 2D:
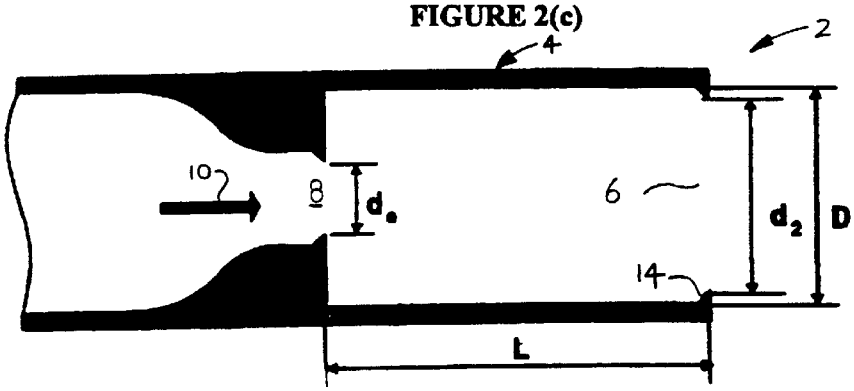
Figure 2E:
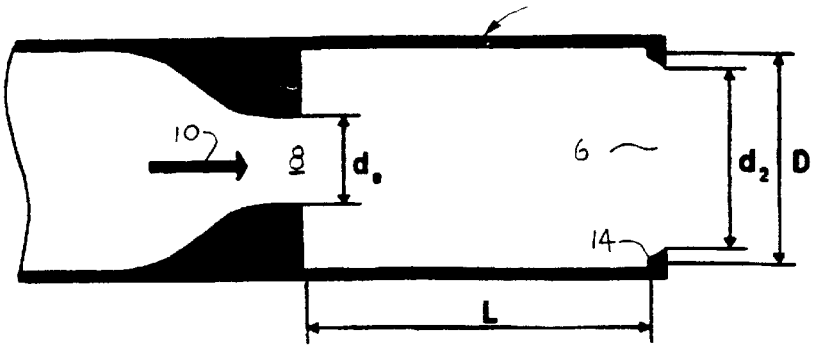
Figure 2F:
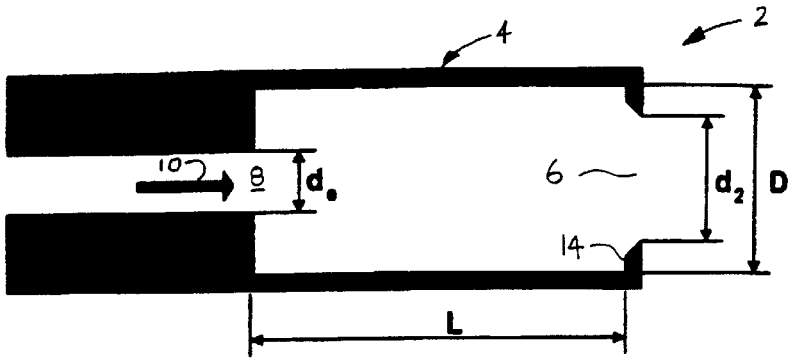
Figure 2G:
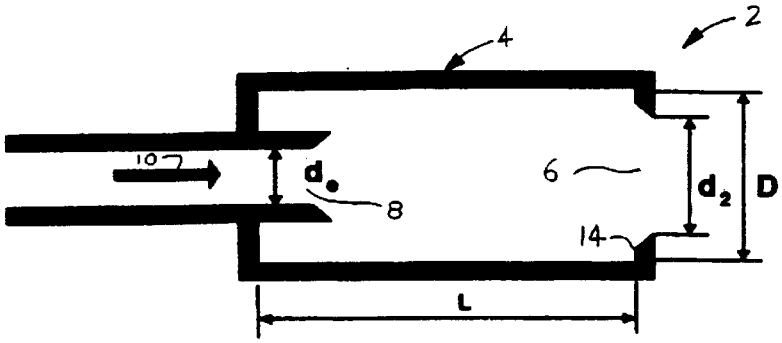
Figure 2H:
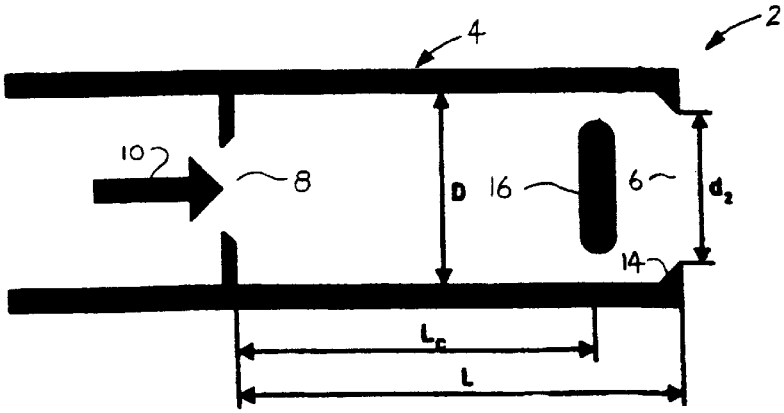

FIG. 1 schematically illustrates a simple fluidic device 2 for exciting an oscillating jet produced in accordance with the method of the present invention. The fluidic device 2 generally comprises a chamber 4 having a fluid outlet 6 longitudinally displaced from a fluid inlet 8. The cross-section of the chamber 4 and/or the fluid outlet 6 may be selectively configured to be circular, rectangular, polygonal, elliptical, hexagonal, or octagonal (other geometric plane figures may be used with advantage in some embodiments). The cross-section of the chamber 4 is advantageously constant, although the cross-section may be varied along the length of the chamber 4 with advantage in some embodiments.

While the actual formation mechanism of oscillating jets within the chamber 4 is highly complex, the general operation of the fluidic device 2 may be described with reference to FIG. 1 wherein fluid jet 10 entering the chamber 4 through fluid inlet 8 is initially separated from the inner surface of the chamber 4. Thereafter, the jet 10 expands through entrainment of the surrounding fluid. This generates a positive feedback process within the chamber 4, causing the jet 12 emerging from the fluid outlet 6 to oscillate. The oscillating jet 12 discharges into the ambient fluid downstream from the fluid outlet 6 and there mixes with the ambient fluid primarily through large-scale enfoldment. It will be appreciated from this description that the fluidic device 2 facilitates the excitation of an oscillating jet 12 without acoustic or mechanical excitation techniques.

FIGS. 2(*a–h*) illustrate a selection of alternative embodiments of fluidic devices 2 for exciting an oscillating jet (not shown) produced in accordance with the present invention. For an asymmetric chamber 4 with constant cross-section, typical geometric ratios $d_e/D$, L/D and $d_2/D$ (wherein L and D represent the chamber length and diameter, $d_e$ is an equivalent diameter of the fluid inlet, defined as the diameter of a virtual asymmetric fluid inlet with the same area, A, as the actual non-axisymmetric fluid inlet, i.e. $d_e \equiv 2\sqrt{A\pi^{-1}}$, and $d_2$ denotes the diameter of the fluid outlet) are, respectively in the ranges: $d_e/D \leqq 0.5$; $L/D \geqq 0.5$; $d_e/D < d_2/D \leqq 1$.

As illustrated in FIGS. 2(*a–h*), the chamber 4 is configured such that there is a discontinuity or other rapid change of cross-section about the fluid inlet 8. As discussed above, the discontinuity or other rapid change of cross-section about the fluid inlet 8 induces fluid jet 10 entering the chamber to initially separate from the inner surface of the chamber. Accordingly, the fluid inlet 8 may be selectively configured to be an orifice (FIGS. 2 (*a–c*)) of relatively short length in the direction of fluid flow in comparison to the length of the chamber. The fluid inlet 8 can also be configured as a smooth contraction with lips (FIG. 2(*d*)) or without (FIG. 2(*e*)), or a simple pipe or passage (FIGS. 2(*f–g*)) of substantial length in the direction of fluid flow. The fluid inlet can have an inwardly directed constricting lip (FIG. 2(*d*)) or an outwardly diverging rim (FIGS. 2(*a*), 2(*b*), 2(*c*)). As also illustrated in FIGS. 2(*a–b*) and FIGS. 2(*d–h*), an inwardly directed lip 14 may be provided at the fluid outlet 6 to define an outlet orifice. The lip 14 can smoothly contract the size of the fluid outlet 6 (FIG. 2(*d*)) or may include an inwardly directed lip 14 that abruptly reduces the size of the fluid outlet 6 or a combination of both (FIGS. 2(*a*), 2(*e*), 2(*f*), 2(*g*)). The lip 14 can also include a downstream portion that smoothly expands the size of the fluid outlet (FIG. 2(*b*)).

FIG. 2(*h*) illustrates an embodiment wherein structure in the form of a centre-body 16 is disposed in the chamber 4 upstream from the fluid outlet 6. The centre-body 16 facilitates the introduction of one or more fluids into the chamber 4. In particular, one or more fluids may be introduced into the centre-body 16 via hollow members that both support the centre-body 16 and feed one or more fluids into the chamber 4. It will be appreciated that in operation the one or more fluids introduced into the chamber 4 via the centre-body 16 are entrained by the oscillating jet formed inside the chamber 4 downstream from the fluid inlet 8. The introduction of one or more fluids into the chamber may alternatively be facilitated by providing the chamber 4 with holes (not shown) such that fluid exterior to the chamber 4 can be admitted into the chamber interior. Further or in the alternative, one or more fluids may be admitted into the chamber from a second chamber (not shown) that at least partially surrounds the chamber 4.

Having described the general structure and operation of the fluidic device 2 for exciting an oscillating jet, the step of determining the characteristics of the oscillating jet 12 in accordance with the method of the present invention will now be described in detail.

Specifically, the mode of oscillation and mixing characteristics of the oscillating jet 12 excited by the fluidic device 2 are determined by selectively configuring the geometry of the fluid inlet 8. In particular, the characteristics of the oscillating jet 12 are manipulated and regulated by empirically varying the geometric configuration (that is, shape and/or dimensions) of the cross-section of the fluid inlet 8. Advantageously, the shape of the cross-section of the fluid inlet 8 is selectively configured to be non-circular. Accordingly, depending on the particular mode of oscillation and mixing characteristics that the oscillating jet 12 is required to exhibit, the shape of the cross-section of the fluid inlet 8 may be selected to be triangular, rectangular, polygonal or elliptical (other geometric plane figures such as crosses and stars may also be used with advantage in some embodiments). As also stated above, the geometry of the cross-section of the fluid inlet 8 is advantageously further selectively configured by varying the dimensions of the cross-section.

Figure 3A:
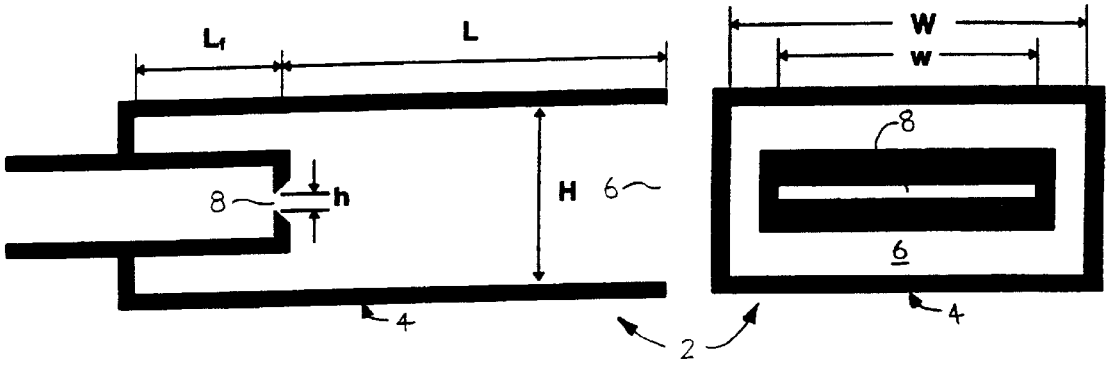
FIGS. 3(*a*) and 3(*b*) are respective side and end views of two embodiments of a fluidic device for exciting an oscillating jet produced in accordance with the present invention.
Figure 3B:
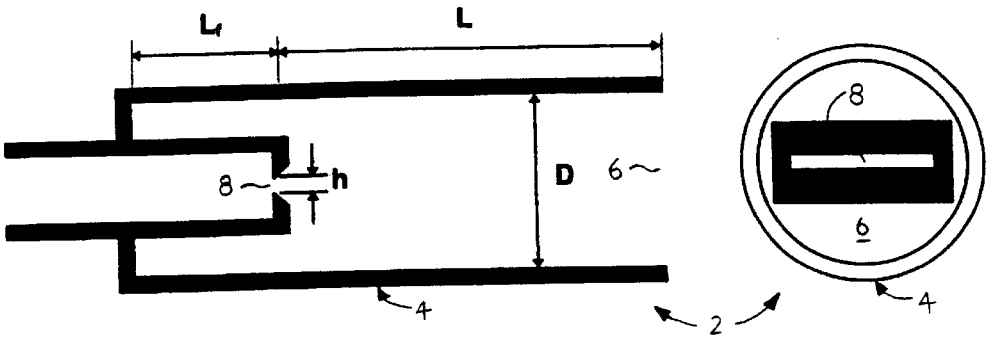

The step of configuring the geometry of the fluid inlet 8 to determine the characteristics of the oscillating jet 12 will now be described in further detail, by way of example only, with reference to FIGS. 3(*a*) and 3(*b*). FIGS. 3(*a*) and 3(*b*) illustrate respective side and end views of two exemplary embodiments of a fluidic device 2 for exciting an oscillating jet. In accordance with the method described above, the detailed geometry of the respective fluid inlets 8 of these two embodiments has been configured such that:

- the cross-section of the fluid inlet is generally rectangular in shape with a high aspect ratio (w/h) in the range of 6 and 15;
- the short (h) and the long (w) sides of the inlet cross-section are parallel to the corresponding sides (H, W) of the chamber cross-section where the chamber is rectangular in cross-section (FIG. 3(*a*));
- the long side (w) of the fluid inlet cross-section is shorter than the long side (W) of the chamber cross section where the chamber is rectangular in cross-section (FIG. 3(*a*)), and the long side (w) of the fluid inlet cross-section is shorter than the chamber diameter (D) where the chamber is circular in cross-section (FIG. 3(*b*));
- the wall structure, chamber and the cross-sections of the fluid inlet and the fluid outlet are each symmetrically disposed about each of their two mutual orthogonal co-planes, that is their centre-planes;
- the ratio of the height H of the chamber to the height h of the fluid inlet is greater than or equal to 4, ie. $H/h \geqq 4$, where the chamber is rectangular in cross-section (FIG. 3(*a*)), an the ratio of the diameter D of the chamber to the height h of the inlet is greater than or equal to 8, $D/h \geqq 8$, where the chamber is circular in cross-section (FIG. 3(*b*));
- the distance ($L_p$) between the fluid inlet to the exit plane and fluid outlet from the inlet plane is greater than approximately 0.3H where the chamber is rectangular in cross-section (FIG. 3(*a*)), and the distance $L_f \geqq 0$ where the chamber is circular in cross-section (FIG. 3(*b*)).

When the geometry of the fluid inlet 8 is configured in the above manner, the mode of oscillation and mixing characteristics of the oscillating jet excited by both fluidic devices 2 illustrated in FIGS. 3(*a*) and 3(*b*) are quasi-planar in nature. As discussed above, such an oscillating jet has come to be generically termed a flapping jet. It will be appreciated that flapping jets have potential practical applicability in industrial processes involving the quasi-planar mixing of fluids due to their enhanced mixing characteristics relative to conventional non-flapping jets. An example of an industrial process where flapping jets could potentially be used with advantage is the manufacture of glass sheets, where glass raw materials are heated by flat-flame burners. Accordingly, the fluidic devices 2 illustrated in FIGS. 3(*a*) and 3(*b*) have potentially advantageous practical applicability as oscillating flat flame burners in the manufacture of glass sheets.

Figure 7A:
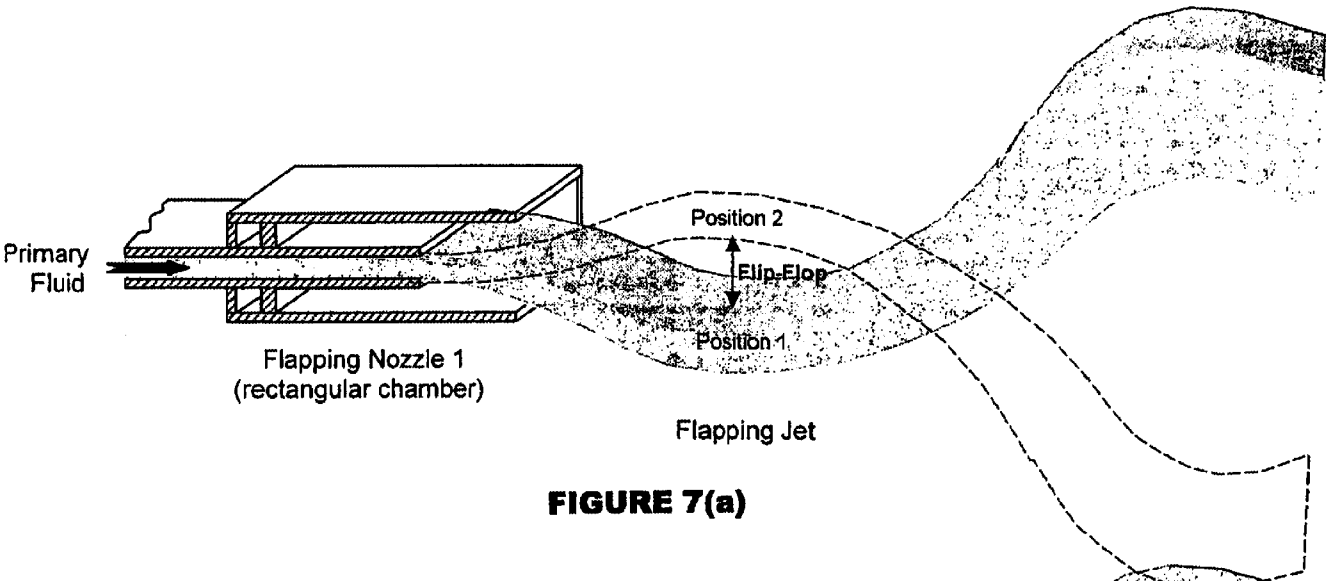
FIGS. 7(*a*) and 7(*b*) illustrate a "flapping jet"which is an example of an oscillating non-precessing jet produced in accordance with the present invention.
Figure 7B:
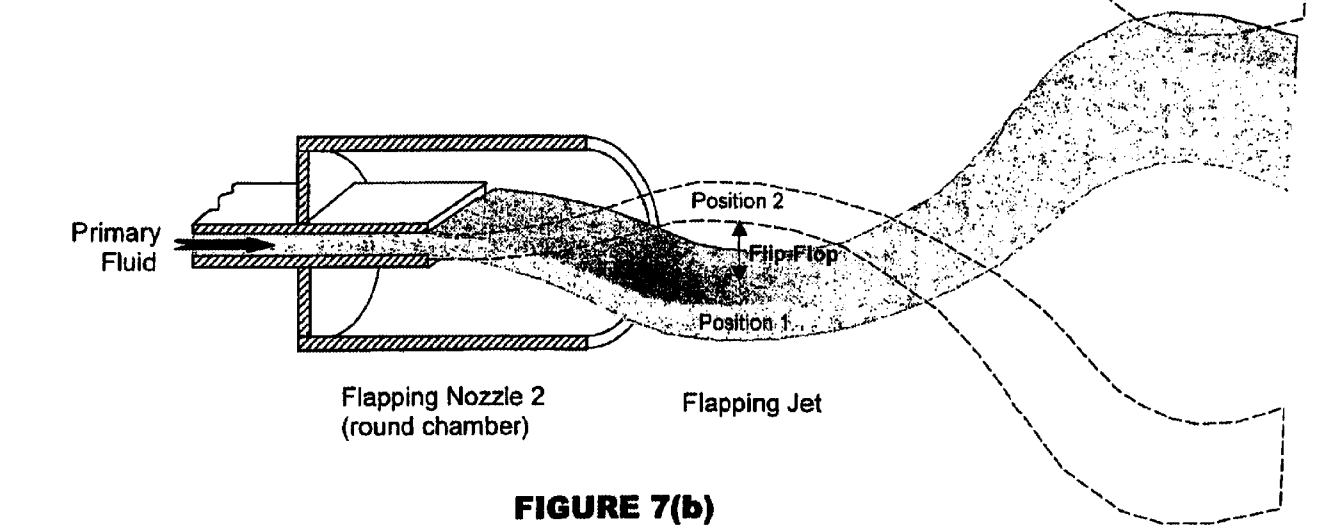

As illustrates in FIGS. 7(*a*) and 7(*b*) the flapping jet is one example of an oscillating non=precessing jet. As such, one of the characteristics of a non-precessing jet is that it does not precess around the chamber walls, instead it attaches to the chamber wall at a given position. On the other hand, an oscillating non-precessing jet has a further feature of oscillating between the positions of attachment, for example "flapping"between position 1 and position 2, as illustrated in FIGS. 7(*a*) and 7(*b*). As further illustrated in FIGS 7(*a*) and 7(*b*), to achieve an oscillating non=precessing jet the cross section of the inlet for primary fluid into the chamber is non-circular, for example-Rectangular, while the chamber may be of any suitable cross-section, for example either rectangle (FIG. 7(*a*)), or circular (FIG. 7(*b*)).

Advantageously, the mode of oscillation and mixing characteristics of the oscillating jet excited by the fluidic devices 2 illustrated in FIGS. 3(*a*) and 3(*b*) may be further determined by selective varying the geometry of the chamber 4. For example, geometric ratios $L \geqq H$ are advantageous for the rectangular chamber of the embodiment illustrated in (FIG. 3(*a*)), while geometric ratios $L \geqq 0.5D$ are advantageous for the circular chamber of the embodiment illustrated in (FIG. 3(*b*)). Furthermore, the angular displacement of the flapping jet (the "flapping angle") excited by the fluidic device 2 having a rectangular chamber (FIG. 3(*a*)) may be increased by configuring the shorter sides of the cross-section of the rectangular chamber to diverge in the downstream direction. Furthermore, the oscillating jet excited by the fluidic device 2 having a rectangular chamber (FIG. 3(*a*)) will flap from side to side essentially in two dimensions when $L/H \geqq 1.0$. Alternatively, the oscillating jet excited by the fluidic device 2 having a circular chamber (FIG. 3(*b*)) will flap in a predominantly two-dimensional mode when L/D is in the range $0.5 \leqq L/D \leqq 1.0$. However, if $L/D \geqq 1.0$, the oscillating jet will oscillate three-dimensionally.

The mode of oscillation and mixing characteristics of the flapping jet excited by the embodiments of the fluidic device 2 illustrated in FIG. 3(*a*) may be further modified by the addition of a centre-body of the type schematically illustrated in FIG. 2(*h*). In particular, when a centre-body is mounted upstream from or at the fluid outlet exit plane such that the centre-body axis is parallel to the major axis of the fluid inlet and these two axes are aligned in one of the planes of symmetry of the whole system (see FIG. 2(*h*)), the range of the circular chamber L/D or the range of the rectangular chamber L/H over which the oscillating jet flaps is expanded. Furthermore, the jet flapping frequency can be increased by the use of a centre-body upstream from or at the outlet exit plane (see FIG. 2(*h*)).

It will be appreciated that the method of the present invention is not limited to the selective configuration of the detailed geometry of fluid inlets having a rectangular cross-section as described above. In particular, the above step of configuring the geometry of the fluid inlet of a fluid device to determine the mode of oscillation and mixing characteristics of an oscillating jet may advantageously be carried out for fluid inlets having a diverse range of cross-sections. For example, the selective configuration of the detailed geometry of a fluid inlet having a triangular shaped cross-section facilitates the manipulation and regulation of an excited oscillating jet whose mode of oscillation and mixing characteristics are three-dimensional in nature. As discussed above, such an oscillating jet has come to be generically termed a precessing jet.

In summary, preferred embodiments of the present invention provide a method for producing a simple fluidic device for exciting an oscillating jet whose mode of oscillation and mixing characteristics can be simply and readily determined such that the performance of the oscillating jet can be optimised for any given industrial application.

Figure 4:
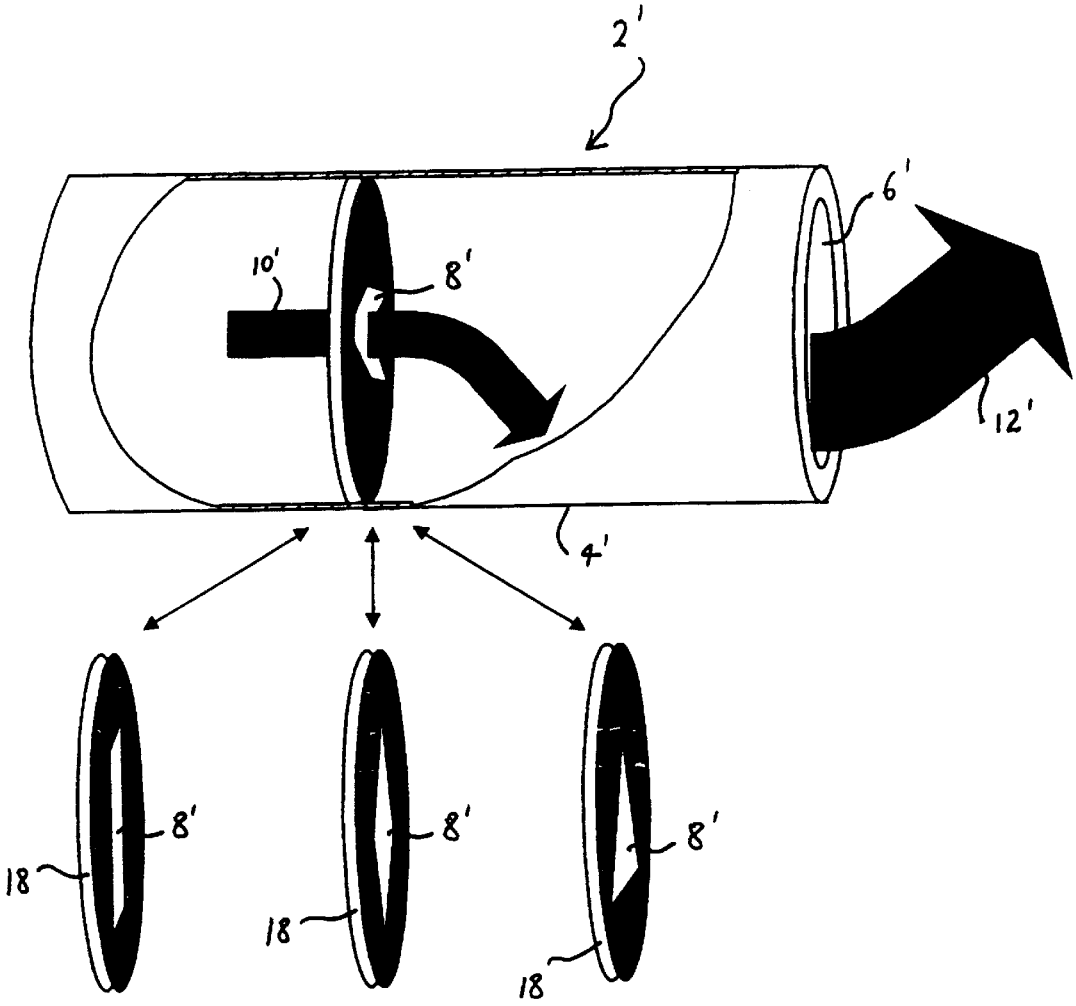
FIG. 4 if a schematic view of a fluidic device for exciting an oscillating jet whose characteristics can be determined to meet operational requirements by the use of interchangeable components.

FIG. 4 schematically illustrates a fluidic device 2' for exciting an oscillating jet 12' whose characteristics can be determined to meet operational requirements. The fluidic device 2' is an analog of the fluidic device 2 and accordingly the foregoing general description of the configuration and operation of the fluidic device 2 is incorporated herein by reference. The fluidic device 2' differs from the fluidic device 2 described above in that the geometry of the fluid inlet 8' is not fixed, but can be selectively varied in service such that mode of oscillation and mixing characteristics of the oscillating jet 12' can be determined to meet operational requirements.

In the illustrated embodiment, the geometry of the fluid inlet 8' is varied in service by alternatively removably positioning one of the disc elements 18 inside the chamber 4'. Each disc element 18 is provided with an orifice that constitutes the fluid inlet 8' when the respective disc elements 18 are removably positioned in the chamber 4'. As illustrated, the orifices of the respective disc elements 18 possess different geometries. Advantageously, the orifices provided in the respective disc elements 18 are non-circular in cross-section. Accordingly, the shape of the cross-section of the orifice may be selected to be triangular, rectangular, polygonal, or elliptical (other geometric plane figures such as crosses and stars may be used with advantage in some embodiments). Conveniently, once the fluidic device 2' has been installed for service in a particular industrial application, the geometry of the fluid inlet 8' can be simply and readily varied by substituting one disc element 18 for another having a differently configured orifice. It will be appreciated from the above description of the method of the present invention that the selective variation of the geometry of the fluid inlet 8' facilitates the manipulation and regulation of the mode of oscillation and mixing characteristics of the oscillating jet 12' excited by the fluidic device 2'. Accordingly, the performance of the oscillating jet 12' excited by the fluidic device 2' can be optimised and/or varied to meet the specific service requirements of any given practical application.

It will be appreciated that the disc elements 18 are merely intended to be illustrative of a range of simple conventional means by which the geometry of the fluid inlet 8' could be varied to suit operational requirements once the fluidic device 2' has been installed for service in a particular industrial application. For example, means could be integrally provided in the fluidic device 2' to vary the geometry of the fluid inlet 8 in situ.

FIG. 5 shows a further embodiment of a fluidic device 2" for exciting an oscillating jet, the characteristics of which can be determined to meet operational requirements. The fluidic device 2" is a further analogue of fluidic devices 2 and 2' described above and the foregoing general description is applicable and will not be repeated. Fluidic device 2" is formed by two chamber elements 4"*a*, 4"*b* which are joined at flanges 5"*a* and 5"*b*. The flanges 5"*a* and 5"*b* are releasably secured together by bolts 7" spaced around the flanges. An annular groove 9" is formed internally of the device 2" between the chamber elements 4"*a* and 4"*b*. A disc element 18" is captively retained in the annular groove 9" when flanges 4"*a* and 4"*b* are secured together. As described in relation to FIG. 4, the disc 18" includes an orifice that constitutes a fluid inlet 8". This arrangement allows the fluid inlet 8" to be varied in service by replacing the disc 18" with a disc having an orifice of different geometry. FIG. 5(*a*) shows some possible orifice geometrics for the disc 18" which include triangular, rectangular, rhomboidal, elliptical, polygonal, cross-shaped and star-shaped orifices. FIG. 5(*b*) shows a disc 18" provided with adjustable tabs 19 for varying the shape of the orifice and thus fluid inlet 8". The triangular tabs 19 are mounted on threaded screws 20 engaged with disc 18" so that the degree of protrusion of the tab 19 into a circular aperture 21 in disc 18" can be adjusted. This variant of disc 18" allows the in-situ adjustment of the shape of the fluid inlet 8". Three possible configurations of the tabs are shown in which the tabs are equally spaced in a plane transverse to the direction of fluid flow.

Figure 6:
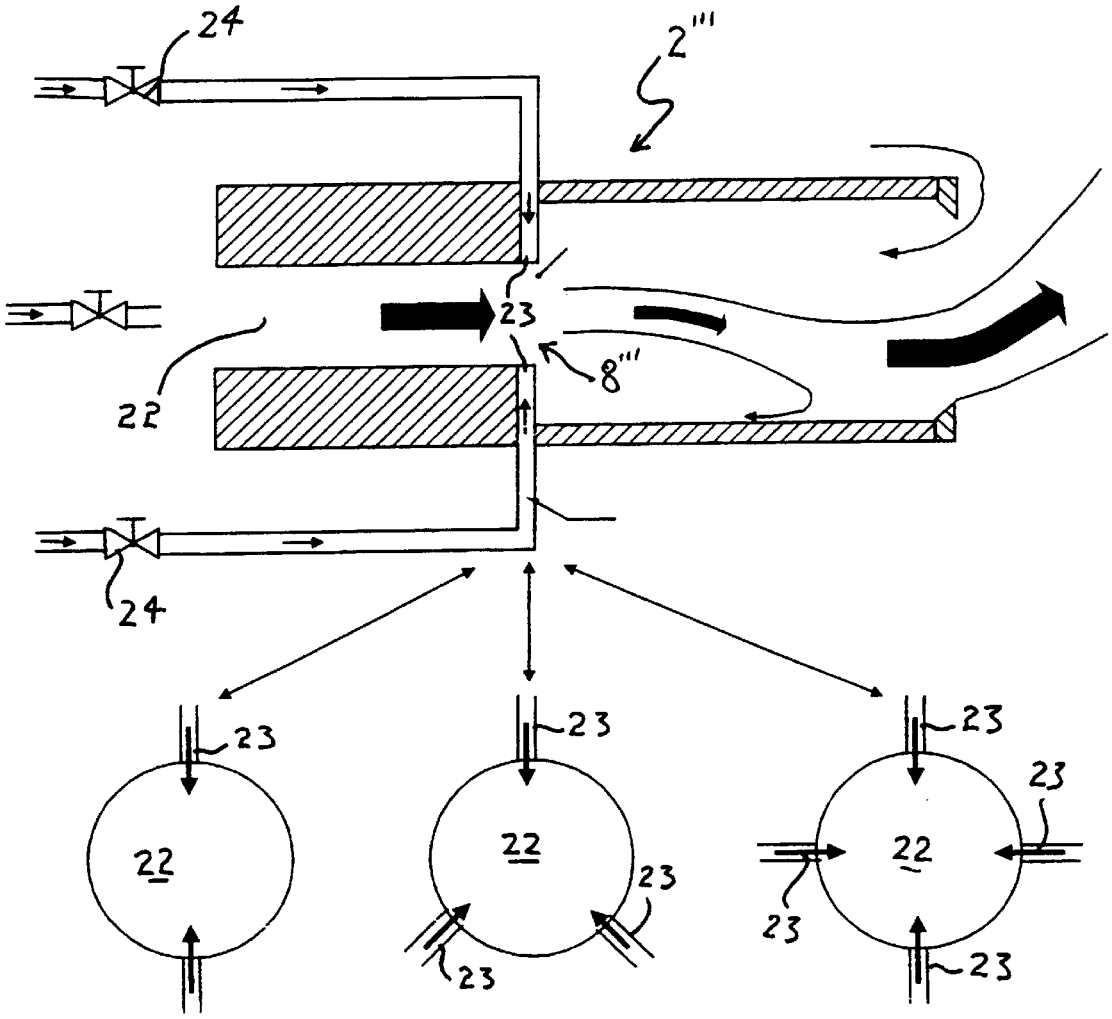
FIG. 6 is a schematic view of a fluidic device for exciting an oscillating jet whose characteristics can be varied in-situ to meet operational requirements by the use of fluidic means to vary the shape of the inlet jet.

FIG. 6 shows a further embodiment of the fluidic device 2''' for exciting an oscillating jet in accordance with the method of this invention. The general operation of the fluidic device 2''' in producing an oscillating jet the same as described above. The fluidic device 2''' has a fluid inlet 8''' formed at the end of a cylindrical passage 22. Small auxiliary side jets 23 are directed into the fluid inlet 8''' to control the shape of the jet. Three configurations of two, three and four side-jets 23 are shown in FIG. 6. Valves shown at 24 are provided to control fluid flow through side-jets 23. The side-jets 23 can be used for fluidic control of the fluid inlet shape and size by creating an aerodynamic blockage or constriction. The fluidic control of the fluid inlet shape and size allows in-situ adjustment and avoids the need for adjustment or replacement of components in the burner environment. Three configurations of the side-jets are shown in which the side-jets are equally spaced in a plane transverse to the direction of fluid flow and each directed toward the centre of the fluid inlet 8".

In summary, the present invention also provides a simple fluidic device for exciting an oscillating jet whose mode of oscillation and mixing characteristics can be simply and readily determined to suit operational requirements after installation.

The above embodiments have been described by way of example only and modifications are possible within the scope of the invention.

The claims defining the invention are as follows:

1. A method of producing a fluidic device for exciting an oscillating non-precessing jet of predetermined oscillation and mixing characteristics, the fluidic device including a chamber having a fluid inlet disposed such that in use fluid entering the chamber through the fluid inlet separates from the inner surface of the chamber to excite a fluidic jet, said method including the step of selectively configuring the fluid inlet to have a non-circular cross-section to cause said fluidic jet to oscillate in a non-precessing manner and produce said oscillating non-precessing jet of predetermined oscillation and mixing characteristics.

2. A method as claimed in claim 1 wherein the chamber and fluid inlet cross sections are symmetrically disposed about each of their mutual orthogonal co-planes.

3. A method as claimed in claim 1 wherein the said step of selectively configuring said fluid inlet includes adjusting an effective cross-section of said fluid inlet by creating an aerodynamic blockage or constriction in said fluid inlet.

4. A method as claimed in claim 3 wherein said aerodynamic blockage or constriction is created by one or more flows of fluid directed into the fluid inlet generally transverse to the direction of flow of fluid through said fluid inlet.

5. A method as claimed in claim 4 said flows of fluid are directed substantially toward the centre of said fluid inlet.

6. A method as claimed in claim 1 wherein the non-circular cross-section is selected from one of a group of triangular, rectangular, polygonal, elliptical, cross and star shapes.

7. A method as claimed in claim 1 wherein the fluid inlet is formed by an orifice of relatively short length in the direction of fluid flow in comparison to the length of the chamber.

8. A method as claimed in claim 1 wherein the fluid inlet is formed by a passage of substantial length in the direction of fluid flow.

9. A method as claimed in claim 7 wherein a downstream end of the fluid inlet includes an inwardly directed constricting lip.

10. A method as claimed in claim 7 wherein a downstream end of the fluid inlet includes an outwardly diverging rim.

11. A method as claimed in claim 8 wherein said passage is of substantially constant cross-section.

12. A method as claimed in claim 8 wherein said passage smoothly contracts toward a downstream end.

13. A method as claimed in claim 1 wherein the chamber includes a fluid outlet defined by an inwardly extending lip.

14. A method as claimed in claim 13 wherein the inwardly extending lip smoothly contracts the size of the fluid outlet.

15. A method as claimed in claim 13 wherein the inwardly extending lip extends generally perpendicular to the inside chamber wall to abruptly reduce the size of the fluid outlet.

16. A method as claimed in claim 15 wherein said lip includes an inner portion which smoothly contracts the size of the fluid outlet.

17. A method as claimed in claim 15 wherein said lip includes a downstream portion which smoothly expands the size of the fluid outlet downstream of said abrupt reduction.

18. A method as claimed in claim 1 further including the step of positioning a body in the central region of the chamber downstream from the fluid inlet, said body being adapted to feed one or more fluids into the chamber for entrainment into the oscillating jet.

19. A method as claimed in claim 18 wherein the body is supported within the chamber by hollow members that also provide fluid flow communication to the body.

20. A method as claimed in claim 1 wherein the fluid inlet has an area A, the chamber is generally cylindrical and has a diameter D and length L and includes fluid outlet of diameter $d_2$ and wherein $d_e/D \leqq 0.5$ $L/D \geqq 0.5$ $d_e/D < d_2/D \leqq 1$ wherein $d_e$ is an equivalent diameter of the fluid inlet given by $$d_e = 2\sqrt{A\pi^{-1}}.$$

21. A method as claimed in claim 1 wherein said fluid inlet is rectangular and has an aspect ratio of width to height in the range 6 to 15.

22. A method as claimed in claim 21 wherein the chamber is rectangular in cross-section and corresponding sides of the fluid inlet and rectangular chamber are substantially parallel.

23. A method as claimed in claim 1 wherein the chamber is circular in cross section.

24. A method as claimed in claim 22 wherein the width of the fluid inlet is less than the width of the rectangular chamber.

25. A method as claimed in claim 23 wherein the width of the fluid inlet is less than the diameter of the chamber.

26. A method as claimed in claim 22 wherein the ratio of the height of the chamber to the height of the fluid inlet is greater than or equal to 4.

27. A method as claimed in claim 23 wherein the ratio of the diameter of the chamber to the height of the fluid inlet is greater than or equal to 8.

28. A method as claimed in claim 26 wherein the fluid inlet extends into the chamber a distance greater than about 0.3 times the height of the fluid inlet.

29. A method as claimed in claim 22 wherein the length of the chamber from the downstream end of the fluid inlet to the fluid outlet from the chamber is greater than or equal to the height of the chamber.

30. A method as claimed in claim 23 wherein the ratio of the length of the chamber from the downstream end of the fluid inlet to the fluid outlet from the chamber to the diameter of the chamber is greater than or equal to 0.5 and less than or equal to 1.

31. A method as claimed in claim 23 wherein the ratio of the length of the chamber from the downstream end of the fluid inlet to the fluid outlet from the chamber to the diameter of the chamber is greater than 1.

* * * * *